US010035355B2

(12) United States Patent
Komplin

(10) Patent No.: US 10,035,355 B2
(45) Date of Patent: Jul. 31, 2018

(54) PACKAGING SYSTEM FOR FLUIDIC EJECTION CARTRIDGE WITH CARTRIDGE ORIENTATION CONTROL

(71) Applicant: Funai Electric Co., Ltd., Osaka (JP)

(72) Inventor: Steven Komplin, Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 15/292,189

(22) Filed: Oct. 13, 2016

(65) Prior Publication Data

US 2018/0104956 A1 Apr. 19, 2018

(51) Int. Cl.
*B41J 2/175* (2006.01)
*B41J 2/01* (2006.01)
*B41J 2/17* (2006.01)

(52) U.S. Cl.
CPC ..... *B41J 2/17533* (2013.01); *B41J 2/01* (2013.01); *B41J 2/1707* (2013.01); *B41J 2/17513* (2013.01); *B41J 2/17536* (2013.01)

(58) Field of Classification Search
None
See application file for complete search history.

(56) References Cited

U.S. PATENT DOCUMENTS 5,131,539 A 7/1992 Karita et al.
5,231,416 A 7/1993 Teraswaw et al.
5,621,450 A 4/1997 Kawai et al.
5,701,995 A 12/1997 Higuma et al.
6,164,769 A 12/2000 Inada et al.
D589,553 S * 3/2009 Sulser ..... D18/56
8,052,257 B2 11/2011 Gonzales
2002/0186284 A1 12/2002 Anma et al.
2003/0081087 A1 5/2003 Sakai et al.
2005/0099471 A1 5/2005 Mukai et al.
2009/0040281 A1 * 2/2009 Sulser ..... B41J 2/17506 347/86

FOREIGN PATENT DOCUMENTS

EP 0999061 A2 5/2000

* cited by examiner

*Primary Examiner* — Erica Lin
(74) *Attorney, Agent, or Firm* — Luedeka Neely Group, PC

(57) ABSTRACT

A packaged fluidic ejection cartridge assembly is disclosed. The cartridge assembly includes a cartridge for fluidic ejection, a cartridge storage container, and a cartridge retainer rotatably attached to the container so as to rotate about a pivot axis. The cartridge retainer receives and secures the cartridge within the storage cup. A moisture barrier film is sealed over the storage cup. The storage container may be stored with the pivot axis in either a substantially horizontal position or a substantially vertical position. The center of mass of the cartridge retainer and the cartridge within the retainer are offset from the pivot axis so that the center of mass rotates to a position below the pivot axis when the packaged cartridge assembly is stored with the pivot axis in a substantially horizontal position.

19 Claims, 8 Drawing Sheets

PACKAGING SYSTEM FOR FLUIDIC EJECTION CARTRIDGE WITH CARTRIDGE ORIENTATION CONTROL

FIELD

This disclosure relates to the field of product packaging systems. More particularly, this disclosure relates to a packaging system for the shipping and storage of fluidic ejection cartridge.

BACKGROUND

Fluidic ejection cartridges may be used in variety of applications, including for instance inkjet printing applications. The amount of time such cartridges remain in transit from the manufacture and/or in storage (prior to installation and use) may constitute a large portion of the lifecycle of the cartridge. In some instances, the shipping and storage time may even constitute the majority of the lifecycle of the cartridge. Consequently, it is important that the operability of the cartridge not degrade during storage, even if the cartridge remains in storage for an extended period of time.

In this regard, fluidic ejection cartridges such as consumer inkjet printing cartridges typically include a volume of an ejectable fluid made up of pigments or other solid particles dispersed in an aqueous mixture. These solid particles have a tendency to settle during shipping and storage (i.e., they are "settleable solids"), and thus the fluid in the cartridge may need to be remixed prior to actual usage. In some instances, however, the solid particles in the fluid may settle in a manner which makes it impossible to satisfactorily remix the cartridge contents, thus rendering the cartridge unusable.

It is thus desirable to provide a packaging system for the fluidic ejection cartridges which eliminates, or at least substantially reduces, the likelihood that the fluid mixture in the cartridge will separate and settle, during shipping and/or storage, in a manner which renders the cartridge unusable.

Moreover, a length of tape or other film is also often applied over the ejection chip of the cartridge during shipping and transport in order to protect the ejection chip as well as to prevent potential fluid leaks from the cartridge. However, later removal of this protective tape may itself prove to be problematic and lead to damage of the ejection chip. Moreover, consumers may at times forget to remove the protective tape from the cartridge before attempted usage, thus rendering the cartridge inoperable.

Accordingly, it is also desirable to provide a system to insure that the protective film is removed from the cartridge prior to installation and usage, and to remove the protective film in a manner which minimizes the likelihood of damage to the ejection chip or other components of the cartridge.

SUMMARY

The above and other needs are met by a packaging system for a fluidic ejection cartridge according to the present disclosure.

In a first aspect, the present disclosure provides a packaged fluidic ejection cartridge assembly. According to one embodiment, the cartridge assembly includes a cartridge for fluidic ejection. This cartridge includes a cartridge body having a plurality of cartridge walls, a cartridge lid attached to a first portion of the cartridge body, and a hollow cavity within the cartridge body defining a fluid reservoir. The cartridge also includes a fluidic ejection chip attached a second portion of the cartridge body and in fluid flow communication with the fluid reservoir, as well as a volume of an ejectable fluid disposed within the fluid reservoir.

The cartridge assembly also includes a cartridge storage container having a storage space within the container. A cartridge retainer is rotatably attached to the storage container within the storage space so as to rotate about a pivot axis. This cartridge retainer includes a plurality of retainer walls and a retainer opening so as to receive and secure the cartridge.

The storage container may be stored with the pivot axis in either a substantially horizontal position or a substantially vertical position. The center of mass of the cartridge retainer and the cartridge within the retainer are offset from the pivot axis so that the center of mass rotates to a position below the pivot axis when the packaged cartridge assembly is stored with the pivot axis in a substantially horizontal position.

In a second aspect, the present disclosure provides a storage package for a fluidic ejection cartridge. The storage package may be used with a cartridge having a cartridge body having a plurality of cartridge walls, a cartridge lid attached to a first portion of the cartridge body, and a hollow cavity within the cartridge body defining a fluid reservoir. The cartridge also includes a fluidic ejection chip attached a second portion of the cartridge body and in fluid flow communication with the fluid reservoir.

The storage package itself includes a cartridge storage container having a storage space within the container. A cartridge retainer is rotatably attached to the storage container within the storage space so as to rotate about a pivot axis. This cartridge retainer includes a plurality of retainer walls and a retainer opening so as to receive and secure the cartridge.

The storage container may be stored with the pivot axis in either a substantially horizontal position or a substantially vertical position. The center of mass of the cartridge retainer and the cartridge within the retainer are offset from the pivot axis so that the center of mass rotates to a position below the pivot axis when the packaged cartridge assembly is stored with the pivot axis in a substantially horizontal position.

In certain embodiments according to the present disclosure, the cartridge also includes a foam element disposed within the fluid reservoir. In such instances, the cartridge may be preferably secured within the retainer such that, after the center of mass rotates to a position below the pivot axis when the packaged cartridge assembly is stored with the pivot axis in a substantially horizontal position, the ejection chip is oriented in a substantially vertical orientation.

In other embodiments according to the present disclosure the cartridge also includes a rotatable stir bar disposed within the fluid reservoir. In such instances, the cartridge may be preferably secured within the retainer such that, after the center of mass rotates to a position below the pivot axis when the packaged cartridge assembly is stored with the pivot axis in a substantially horizontal position, the ejection chip is oriented in a substantially horizontal orientation.

In certain embodiments according to the present disclosure, the cartridge storage container preferably includes a cartridge storage cup having a cup bottom, at least one cup sidewall, and a storage space within the cup. In some instances, this cartridge storage cup is preferably made from a polymeric material selected from the group consisting of polypropylene, polyethylene, and polystyrene.

In some embodiments according to the present disclosure, the packaged fluidic ejection cartridge assembly also preferably includes a moisture barrier film disposed over at least the cartridge. In some instances, this moisture barrier film is preferably a multi-layer film having at least one layer which is made from a polymeric material selected from the group consisting of polypropylene, polyethylene, and polystyrene.

In certain embodiments according to the present disclosure, the packaged fluidic ejection cartridge assembly also includes preferably a moisture barrier film which is thermally sealed to an upper lip area of the cartridge storage cup.

In certain embodiments according to the present disclosure, the ejectable fluid preferably include settleable solids. In some embodiments for example, the ejectable fluid may be a printing ink which includes a pigment.

In certain embodiments according to the present disclosure, the cartridge body preferably includes at least four cartridge walls.

In certain embodiments according to the present disclosure, the cartridge preferably also includes a flexible interconnect circuit which is attached to the cartridge body and electrically connected to the fluidic ejection chip.

In certain embodiments according to the present disclosure, the cartridge is preferably secured within the cartridge retainer such that the flexible interconnect circuit is disposed adjacent one of the retainer walls. In other embodiments, the cartridge is preferably secured within the cartridge retainer such that the flexible interconnect circuit is disposed adjacent the retainer opening.

In a third aspect, the present disclosure provides a film sealed fluidic ejection cartridge assembly. According to one embodiment of the disclosure, the cartridge assembly includes a cartridge for fluidic ejection. This cartridge includes a cartridge body having a plurality of cartridge walls, a cartridge lid attached to a first portion of the cartridge body, and a hollow cavity within the cartridge body defining a fluid reservoir. The cartridge also includes a fluidic ejection chip attached to a second portion of the cartridge body and in fluid flow communication with the fluid reservoir.

The cartridge assembly also includes a cartridge retainer. This cartridge retainer includes a plurality of retainer walls and a retainer opening. The cartridge retainer receives and secures the cartridge.

The cartridge assembly further includes a length of a nozzle plate seal film. A first portion of the nozzle plate seal film is removably secured to the fluidic ejection chip and a second portion of the nozzle plate seal film is secured to the cartridge retainer. Removal of the cartridge from the cartridge retainer causes the nozzle plate seal film to separate from the fluidic ejection chip.

In some embodiments according to the present disclosure, this film sealed fluidic ejection cartridge assembly may also include a cartridge storage container having a storage space within the container. The cartridge retainer is rotatably attached to the storage container within the storage space so as to rotate about a pivot axis. A moisture barrier film disposed over at least the cartridge may also be included.

In certain embodiments according to the present disclosure, the second portion of the nozzle plate seal film is preferably secured to a retainer wall of the cartridge retainer.

In some embodiments according to the present disclosure, the nozzle plate seal film comprises is preferably a low tack tape having an adhesion force of less than 1.0 lbf per inch when secured to the fluidic ejection chip.

In certain embodiments according to the present disclosure, the film sealed fluidic ejection cartridge assembly may also include a length of high tack tape secured to the second portion of the nozzle plate seal film and to the cartridge retainer so that the nozzle plate seal film is secured to the cartridge retainer. In some instances, this high tack tape preferably has an adhesion force of greater than 1.0 lbf per inch when secured to the outer surface of the first retainer wall.

In certain embodiments according to the present disclosure, the cartridge preferably also includes a flexible interconnect circuit which is attached to the cartridge body and electrically connected to the fluidic ejection chip.

In certain embodiments according to the present disclosure, the cartridge is preferably secured within the cartridge retainer such that the flexible interconnect circuit is disposed adjacent one of the retainer walls. In certain other embodiments according to the present disclosure, the cartridge is preferably secured within the cartridge retainer such that the flexible interconnect circuit is disposed adjacent the retainer opening.

In still another aspect, the present disclosure provides a method for removing a protective tape from a fluidic ejection chip on a cartridge for fluidic ejection. According to one embodiment, the method includes a first step of providing a fluidic ejection cartridge assembly. The cartridge assembly includes a cartridge for fluidic ejection having a cartridge body with a plurality of cartridge walls, a cartridge lid attached to a first portion of the cartridge body, a hollow cavity within the cartridge body defining a fluid reservoir, and a fluidic ejection chip attached to a second portion of the cartridge body and in fluid flow communication with the fluid reservoir. The cartridge assembly also includes a cartridge retainer, having a plurality of retainer walls and a retainer opening, which receives and secures the cartridge.

The method includes a second step of applying a length of a nozzle plate seal film over at least a portion of the fluidic ejection chip, wherein a first portion of the nozzle plate seal film is removably secured to the fluidic ejection chip and a second portion of the nozzle plate seal film is secured to the cartridge retainer. Later removal of the cartridge from the cartridge retainer causes the nozzle plate seal film to separate from the fluidic ejection chip.

In certain embodiments of this method, the tape separating from the fluidic ejection chip preferably peels away at an angle of approximately 180 degrees from the fluidic ejection chip.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The present disclosure provides a storage package for a fluidic ejection cartridge, as well as a packaged fluidic ejection cartridge assembly, which substantially reduces the likelihood that the fluid mixture in the cartridge will separate and settle, during shipping and/or storage, in a manner which renders the cartridge unusable. Moreover, the present disclosure also provides a film sealed fluidic ejection cartridge assembly and a method for removing the cartridge from this assembly which minimizes the likelihood of damage to the ejection chip or other components of the cartridge.

As noted above, fluidic ejection cartridges may be used in variety of applications, including for instance inkjet printing applications. Fluidic ejection cartridges may also be used for other nonprinting applications as well, particularly for applications calling for the precise metering of small amounts of liquid materials. For instance, ejection cartridges may also be used in the preparation of cosmetics, paints, or lubricants.

Figure 1:
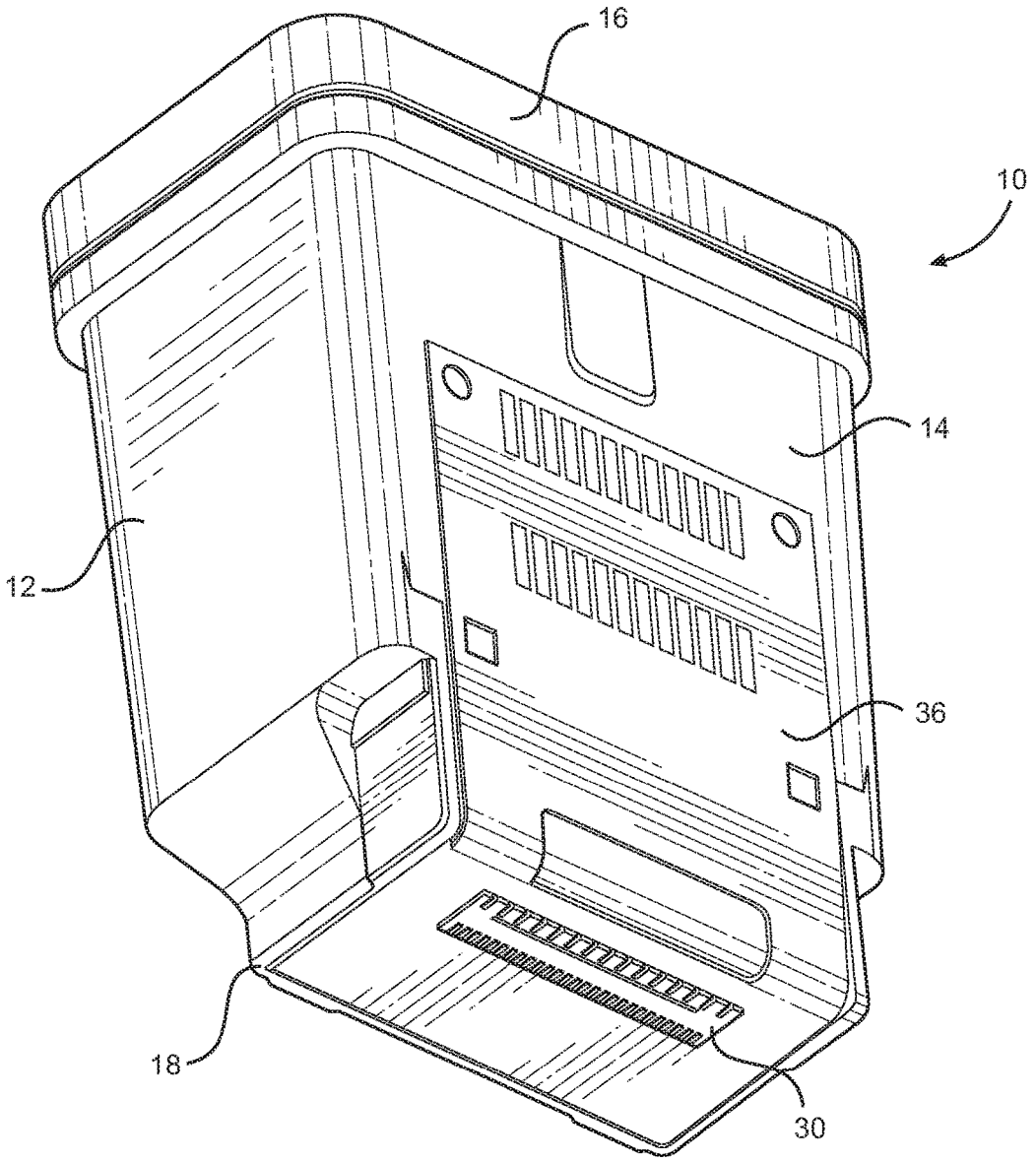
FIG. 1 is a bottom perspective view of a fluidic ejection cartridge.
Figure 2:
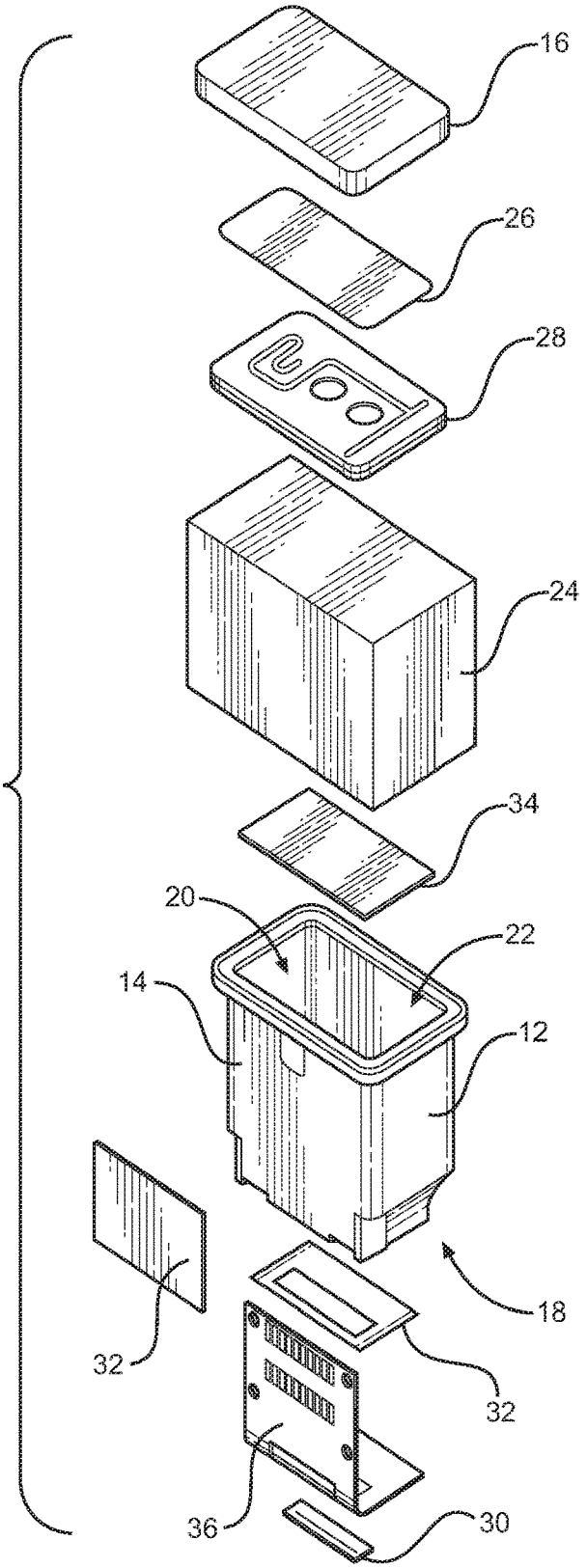
FIG. 2 is an exploded perspective view of a fluidic ejection cartridge.

As illustrated in FIGS. 1 & 2, a fluidic ejection cartridge 10 may include a cartridge body 12 having a plurality of cartridge walls 14, and more preferably at least four cartridge walls 14. A cartridge lid 16 is attached to a first portion of the cartridge body 12. A cartridge bottom plate 18 may be attached to a second portion of the cartridge body 12. In some instances, the cartridge lid 16 and/or bottom plate 18 may be attached to the cartridge body 12 by being integrally molded with the cartridge body 12. In other instances, the cartridge lid 16 and/or bottom plate 18 may be separately formed and attached to the cartridge body 12 by being sealed with adhesive, ultrasonic welding, etc. The interior of the cartridge body 12 includes a hollow cavity 20 which defines a fluid reservoir 22.

In general, the cartridge 10 preferably also includes a volume of an ejectable fluid disposed within the fluid reservoir 22. This fluid may include settleable solids. For inkjet printing cartridges for instance, the ejectable fluid is a printing ink which includes a mixture of an aqueous or organic solvent and solid particles of a pigment for use in printing which may tend to settle out of suspension over time.

In some embodiments, the cartridge 10 may also preferably include a foam element 24, which is disposed within the fluid reservoir 22 together with the volume of ejectable fluid. In other embodiments, however, the foam element 24 may be omitted, and the fluid reservoir 22 may instead include a magnetically operated stir bar for remixing of the ejectable fluid.

In some instances, the cartridge 10 may also include a vent cover 26 and/or an inner lid 28 situated within the cartridge body 12 below the cartridge lid 16 and above the foam element 24.

The cartridge also includes a fluidic ejection chip 30 attached to the second portion of the cartridge body 12 (generally the bottom plate 18) having a plurality of nozzles for ejection of the fluid. The ejection chip 30 is fluid flow communication with the fluid reservoir 22 and the ejectable fluid within the reservoir 22, via a hole in the bottom plate 18. The ejection chip 30 may be attached to the cartridge using a thermal cure adhesive for instance. In certain embodiments, the cartridge 10 preferably also preferably includes a fluid filter element 34 disposed between the fluid reservoir 22 and the fluidic ejection chip 30.

The cartridge 10 also typically includes a flexible interconnect circuit 36 which is attached to one of the cartridge walls 14 and electrically connected to the fluidic ejection chip, for providing electronic control of the ejection chip 30. The flexible interconnect circuit 36 may be attached to the cartridge 10 using one or more pieces of pressure sensitive adhesive 32.

As discussed above, the ink pigments or other solids in the cartridge may settle during storage, and the cartridge has to be remixed prior to use. Sometimes the pigments or other solids settle in a way that cannot be satisfactorily remixed. In this regard, it has been observed that the likelihood for the cartridge to become unmixable and thus unusable in this manner may depend upon the construction of the cartridge and the orientation of the cartridge during shipping and storage. In particular, it has been observed that a non-remixable settling of the pigments is most likely to occur in a fluidic ejection cartridge which includes a stir bar when the cartridge is stored with the ejection chip and its nozzles are facing downward. For fluidic ejection cartridge which include a foam element and which are not stirred, unrecoverable settling of the fluid pigments is most likely to occur when the ejection chip and its nozzles are facing either upward or downward. Thus, it is believed that a fluidic ejection cartridge is more preferably stored with the ejection chip in a sideways orientation, facing neither upward or downward.

Figure 4:
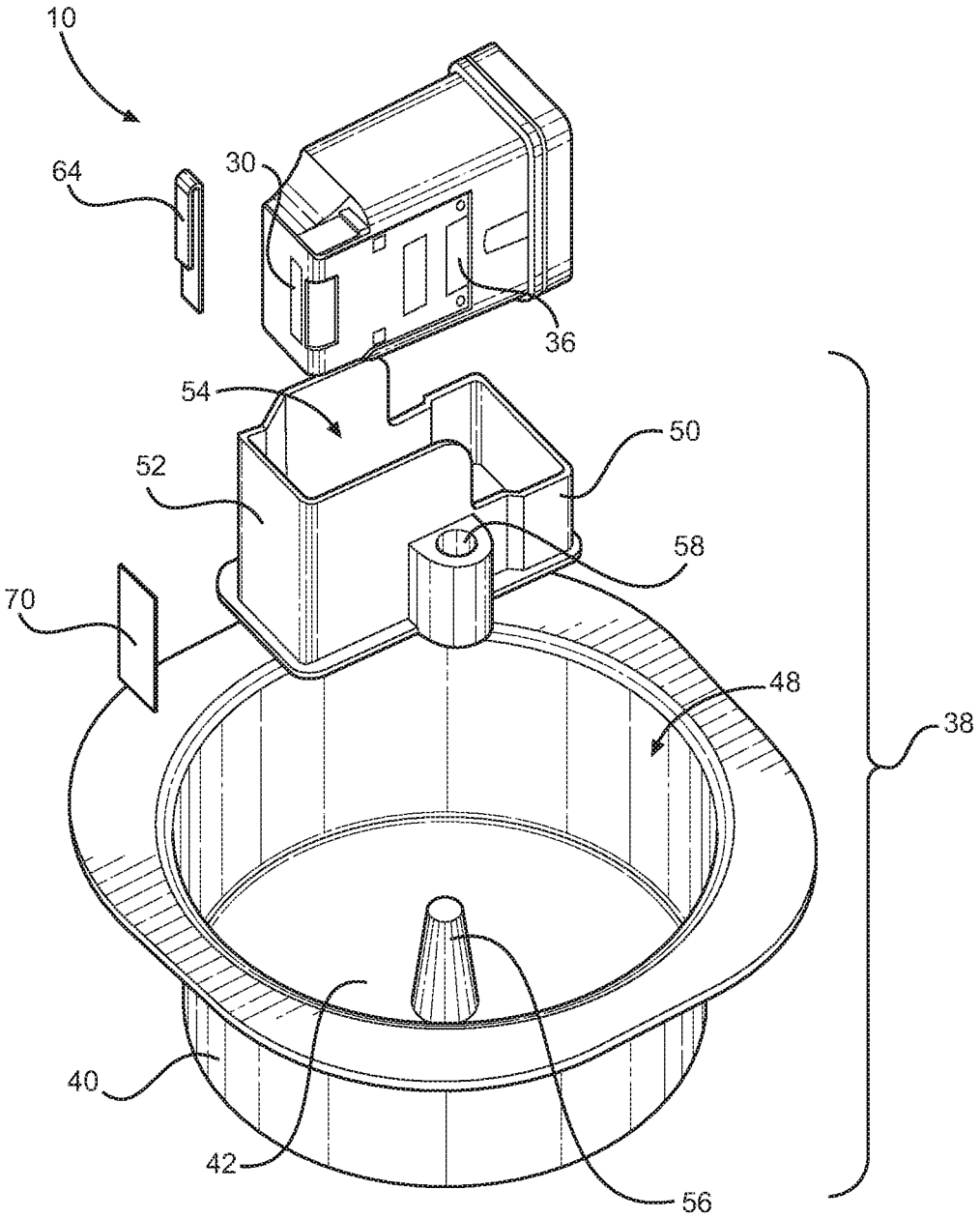
FIGS. 4-6 are top perspective views illustrating the placement of a fluidic ejection cartridge into a cartridge assembly in accordance with one embodiment of the present disclosure.

This is accomplished by placing the fluidic ejection cartridge 10 within a storage package 38 according to the present disclosure for transport and storage. An example of such a storage package 38 is shown in FIG. 4. This storage package 38 includes a storage container such as a cartridge storage cup 40. The storage cup 40 includes a cup bottom 42, at least one cup sidewall 44, an upper lip area 46, and a storage space 48 within the cup 40. In general, the storage cup 40 is preferably made from a polymeric material selected from the group consisting of polypropylene, polyethylene, and polystyrene.

Inside the storage space 48 within the cup 40, a cartridge retainer 50 is rotatably attached to the cup bottom 42. This cartridge retainer 50 includes a plurality of retainer walls 52, generally four, and a retainer opening 54. The retainer opening 54 is generally, but not necessarily at the top of the cartridge retainer 50. The retainer walls 52 are shaped and configured to conform to the shape of the fluidic ejection cartridge 10, so that the cartridge 10 may be received and secured with the cartridge retainer 50. The cartridge retainer may also include weights or other additional structure which may be used to alter the center of mass of the cartridge retainer 50.

Preferably, the cup bottom 42 includes a central pin or shaft 56, and the cartridge retainer 50 is attached to this shaft 56 by an aperture 58 formed on a side of the cartridge retainer 50 which is fitted over the shaft 56. Thus, the retainer 50 and the cartridge 10 within the retainer may spin or pivot within the storage cup 40 about the pivot axis defined by the shaft 56, with the center of mass of the cartridge retainer and the cartridge within the retainer being offset from this pivot axis.

Figure 7:
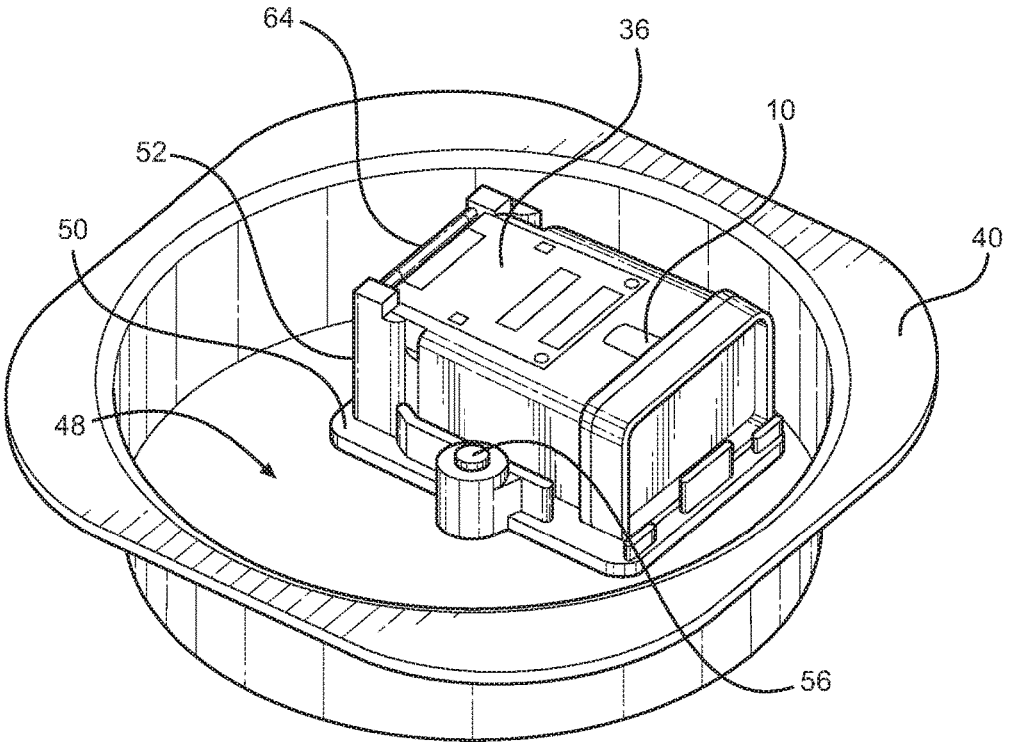
FIG. 7 is a top perspective view of a cartridge assembly in accordance with a second embodiment of the present disclosure.
Figure 8:
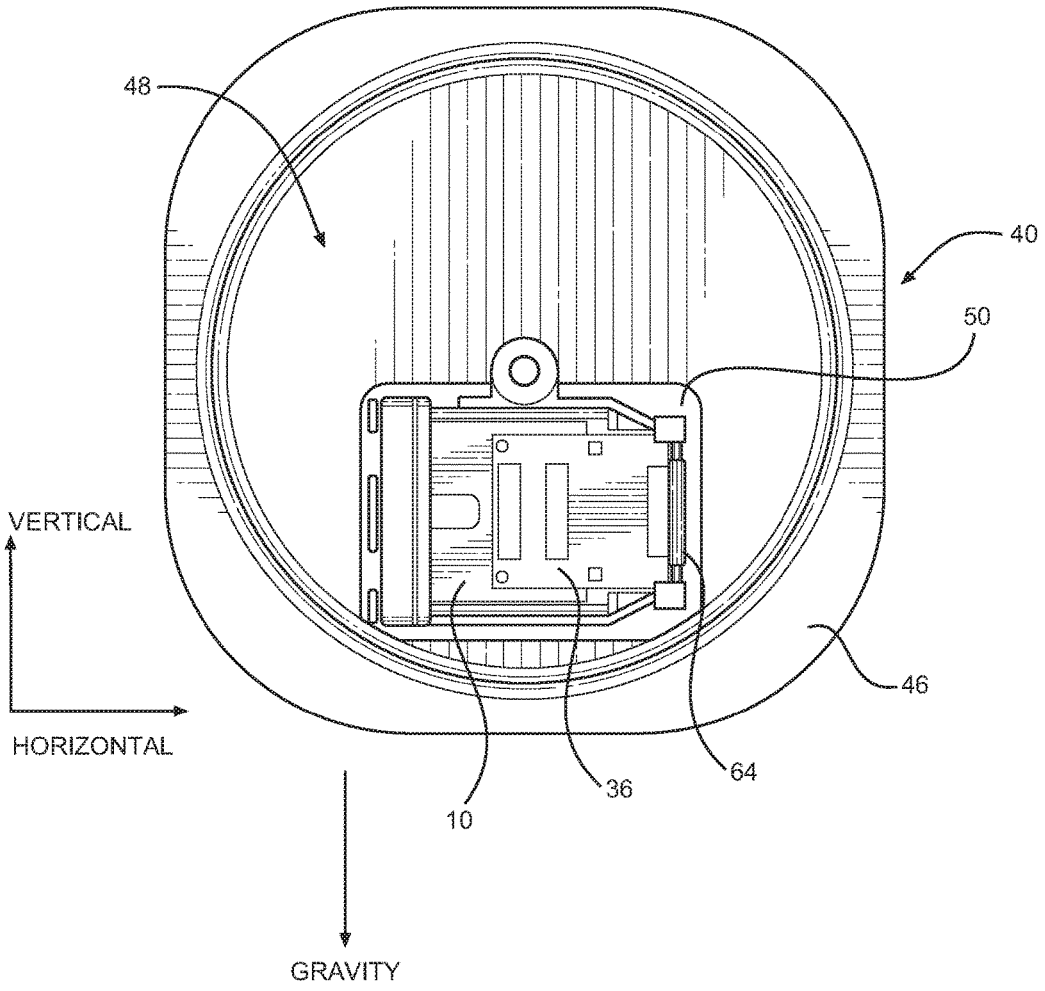
FIG. 8 is a side elevation view of a cartridge assembly in accordance with a second embodiment of the present disclosure, with the bottom of the storage cup in a substantially vertical orientation.

According to the present disclosure, the cartridge 10 may be received in the cartridge retainer 50 in one of a variety of orientations. In particular, the specific orientation of the cartridge walls 14 within the retainer 50 may vary depending upon the particular embodiment of the disclosure. In some embodiments, the cartridge 10 is preferably secured within the cartridge retainer 50 such that the flexible interconnect circuit 36 attached to the cartridge wall 14 is disposed adjacent one of the retainer walls 52, as shown in FIGS. 3-6. In an alternate embodiment, however, the cartridge 10 is preferably secured within the cartridge retainer 50 such that the flexible interconnect circuit 36 attached to the cartridge wall 14 is disposed adjacent the retainer opening 54, as shown in FIGS. 7 & 8.

Once the cartridge is secured within the storage package 38, a moisture barrier film 60 is preferably disposed over at least the cartridge 10 in order to protect the cartridge 10 from moisture and other environmental hazards during shipping and/or storage. In some instances, the moisture barrier film 60 may be disposed over only the cartridge 10, i.e. the cartridge 10 may be wrapped in the film 60 prior to be inserted into the cartridge retainer 50. In other instances, the cartridge 10 may be inserted into the retainer 50, and then the moisture barrier film 60 may be disposed over both the cartridge 10 and the retainer 50.

In still another preferred embodiment, the cartridge 10 and retainer 50 may be inserted into the storage cup 40 and the moisture barrier film 60 may be sealed over all or a portion of the cup 40 in order to seal to cartridge 10 within the cup 40. For instance, the cartridge 10 and retainer 50 may be inserted into the storage space 48 within the cup 40 and the moisture barrier film 60 may be sealed to the upper lip area 46 of the cup 40 in order to protect the cartridge 10 from moisture and other environmental hazards during shipping and/or storage.

In general, the moisture barrier film 60 is multi-layer film. When the moisture barrier film 60 is sealed against the storage cup 40, it is desirable that the storage cup 40 and the layer of the moisture barrier film 60 adjacent the storage cup 40 be made from the same or structurally similar polymers as this facilitates thermal bonding and sealing between the material of the storage cup 40 and the moisture barrier film 60. Thus, if the cup 40 is made from a polymeric material selected from the group consisting of polypropylene, polyethylene, and polystyrene as discussed above, it is desirable that the layer of the moisture barrier film 60 adjacent the storage cup 40 likewise be made from a polymeric material selected from the group consisting of polypropylene, polyethylene, and polystyrene. Other polymeric materials which may also be used in the moisture barrier film 60 include polyethylene terephthalate, nylon, and metalized polymers.

The storage package 38 together with the ejection cartridge 10 secured therein and the sealed barrier film 60 collectively make up the finished packaged cartridge assembly 62.

Once assembled and sealed in this manner, the storage cup 40 or other storage container of the packaged cartridge assembly 62 may be stored with the aforementioned pivot axis in either a substantially horizontal position or a substantially vertical position. If the packaged cartridge assembly 62 is stored with the aforementioned pivot axis in a substantially horizontal position, it will be appreciated that the cartridge retainer 50 and the cartridge 10 within the retainer 10 may rotate or pivot about the pivot axis due to the force of the weight of the cartridge retainer 50 and the cartridge 10. In this regard, according to the present disclosure, the center of mass of the cartridge retainer 50 and the cartridge 10 within the retainer 50 are offset from the pivot axis so that the center of mass rotates to a position below the pivot axis when the packaged cartridge assembly 62 is stored with the pivot axis in a substantially horizontal position.

Significantly, this tendency of the center of mass to rotate to a position below the pivot axis, combined with appropriate choice of the orientation of the cartridge 10 within its retainer 50, help to maintain the nozzles of the ejection chip 30 in a desirable orientation during shipping and storage—even if the overall orientation of the packaged cartridge assembly 62 is changed.

In particular, for a cartridge 10 which includes a foam element disposed within the fluid reservoir, it is generally preferred that the ejection chip 30 be maintained in a substantially vertical orientation during storage. Accordingly, such cartridges 10 including a foam element are preferably secured within the retainer 50 in an orientation such that, after the center of mass rotates to a position below the pivot axis (when the packaged cartridge assembly 62 is stored with the pivot axis in a substantially horizontal position), the ejection chip 30 is oriented in a substantially vertical orientation.

On the other hand, for or a cartridge 10 which includes a rotatable stir bar disposed within the fluid reservoir, it is generally preferred that the ejection chip 30 be maintained in a substantially horizontal orientation during storage. Accordingly, such cartridges 10 including a stir bar are preferably secured within the retainer 50 in an orientation such that, after the center of mass rotates to a position below the pivot axis (when the packaged cartridge assembly 62 is stored with the pivot axis in a substantially horizontal position), the ejection chip 30 is oriented in a substantially horizontal orientation, and preferably above fluid reservoir 22.

In another aspect of the disclosure, a removable nozzle plate seal film 64 may be applied to the ejection chip 30 and its associated nozzles to protect the ejection chip 30 and to prevent fluid leakage from the nozzles during shipping and/or transport of the cartridge assembly 62. In some instances, the nozzle plate seal film 64 applied over the ejection chip 30 for this purpose is preferably a tape having a relatively low tack adhesive on at least one side of the tape. Generally, in this context, a low tack tape preferably has an adhesion force of less than 1.0 lbf per inch when secured to the fluidic ejection chip 30.

Figure 5:
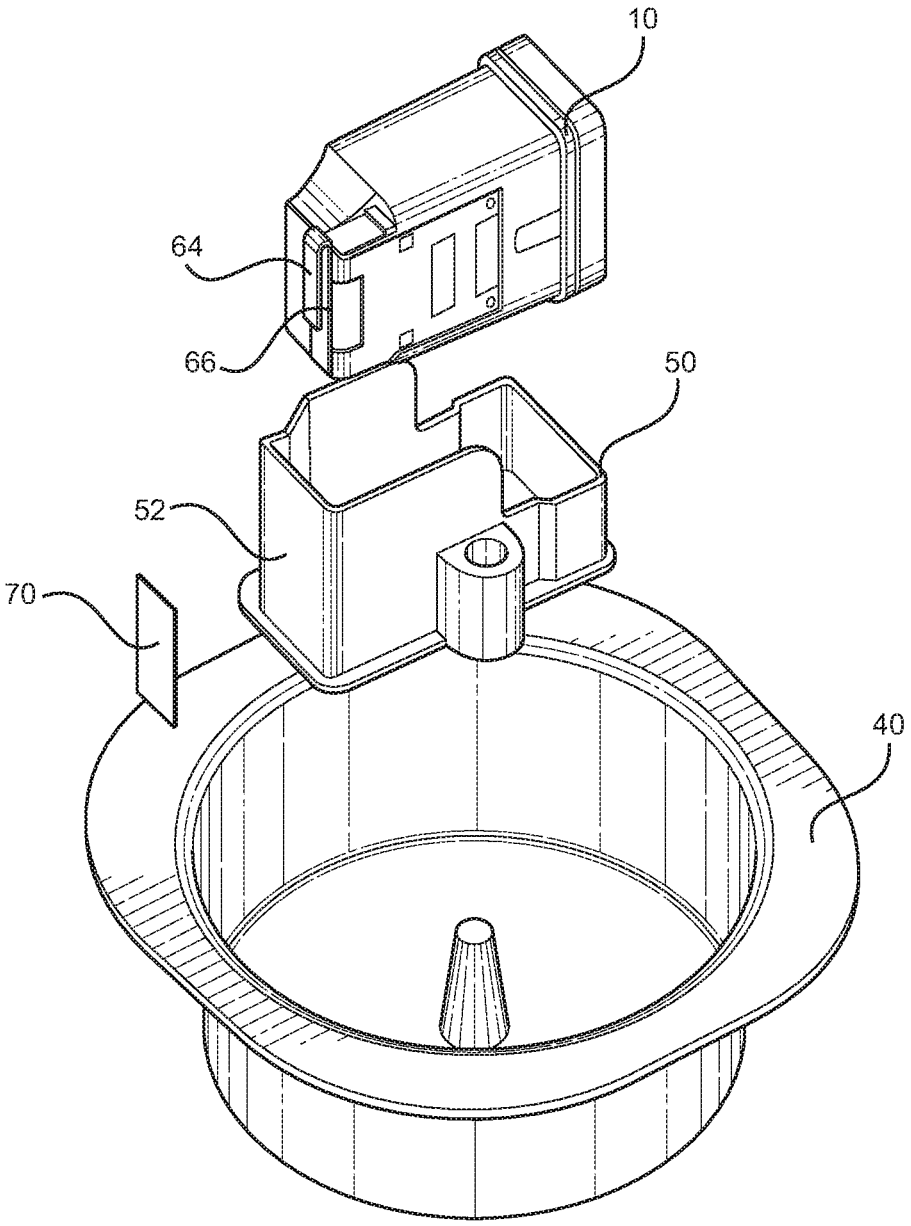
Figure 6:
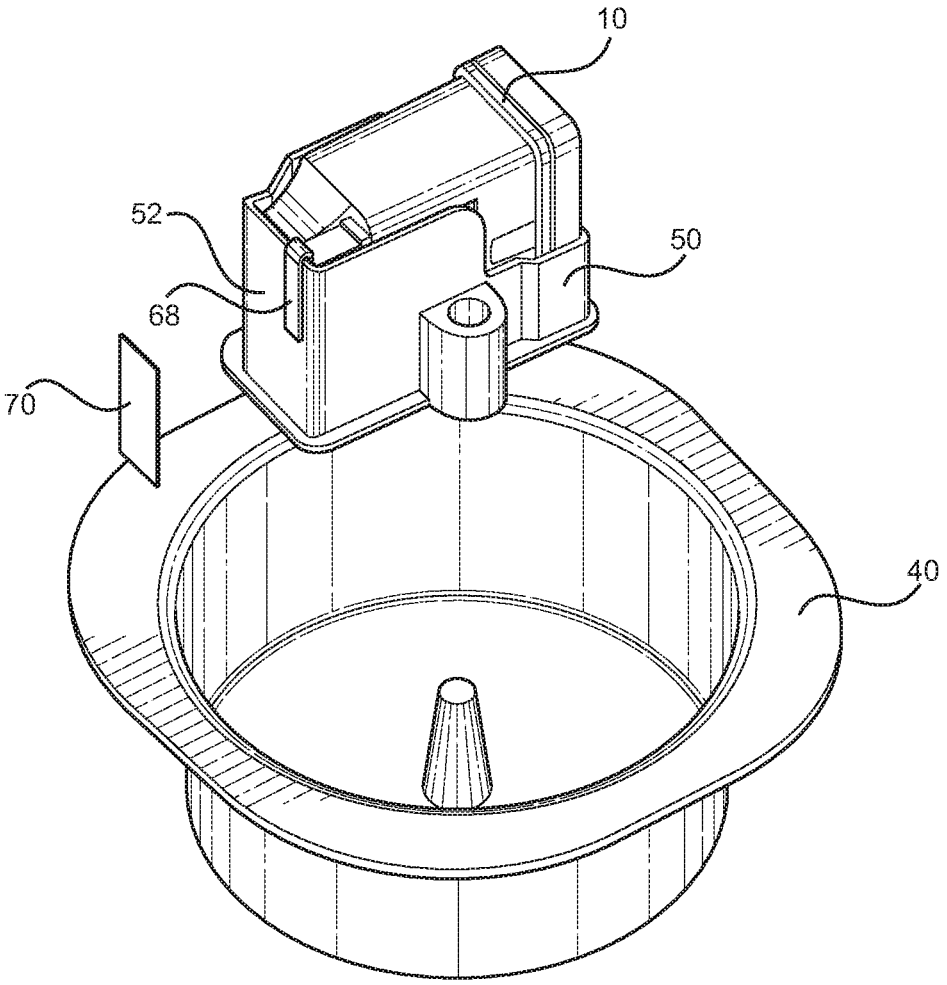

A preferred method for application of the protective tape or other seal film is illustrated in FIG. 4-6. A length of the nozzle plate seal film 64 is used. Initially a first portion 66 of this nozzle plate seal film 64 is removably secured to the fluidic ejection chip 30, as shown in FIG. 4. This is done before the cartridge 10 is inserted into the cartridge retainer 50.

Then, after the cartridge 10 is inserted into the cartridge retainer 50, a second portion 68 of the nozzle plate seal film 64 is secured to the cartridge retainer 50. For instance, the second portion of the low tack tape (or other nozzle plate seal film) may be to an outer surface of a cartridge retainer wall 52, as shown in FIGS. 4 & 5.

Given the relatively low tack nature of this tape, in some instances, a second length of tape 70 may also be used and applied over at least the second portion 68 of the nozzle plate seal film 64. This second length of tape 70 is preferably a tape having a relatively high tack adhesive on at least one side of the tape. Generally, in this context, a high tack tape preferably has an adhesion force of greater than 1.0 lbf per inch when secured to the outer surface of the first retainer wall 52.

This high tack tape 70 may be secured to the second portion 68 of the nozzle plate seal film 64 and also to a portion of a retainer cartridge wall 52 so that the low tack tape is secured to the first retainer wall 52, as shown in FIGS.

5 & 6. For instance, the high tack tape 70 may be secured to the outer surface of the first retainer wall 52.

The first and second lengths of tape 64, 70 are preferably applied to the cartridge 10 and the cartridge retainer 50 prior to the attachment of the cartridge retainer 50 to the shaft 56 in the storage cup 40.

Alternatively, in other embodiments of the present disclosure, the nozzle plate seal film may be provided as a different type of film rather than a tape. Moreover, this film may be secured to the nozzle plates of the ejection chip 30, and to the cartridge retainer 50, by the application of adhesive, mechanical fasteners, and the like.

Advantageously, when the protective tape or other nozzle plate seal film is applied to the fluidic ejection cartridge 10 as described above, later removal of the cartridge 10 from the cartridge retainer 50 causes the tape or other seal film to automatically separate from the fluidic ejection chip 30. In particular, when the cartridge 10 is lifted out of the retainer 50 via the retainer opening 54, the second portion 68 of the nozzle plate seal film 64 remains securely attached to the cartridge retainer 50. The first portion 66 of the nozzle plate seal film 64, however, peels away and separates from the surface of the fluidic ejection chip 30. If the cartridge 10 is pulled straight up out of the retainer, the low tack tape separating from the fluidic ejection chip 30 will peel away at an angle of approximately 180 degrees from the fluidic ejection chip 30.

This is particularly desirable because it has been observed that the forces exerted on the ejection chip 30 by the low tack adhesive—and thus the likelihood of damage to the ejection chip 30—are minimized when the nozzle plate seal film 64 is peeled away from the ejection chip 30 at this angle of approximately 180 degrees. According to the present disclosure, this may be achieved automatically when the cartridge 10 is removed from the cartridge retainer 50.

Figure 3:
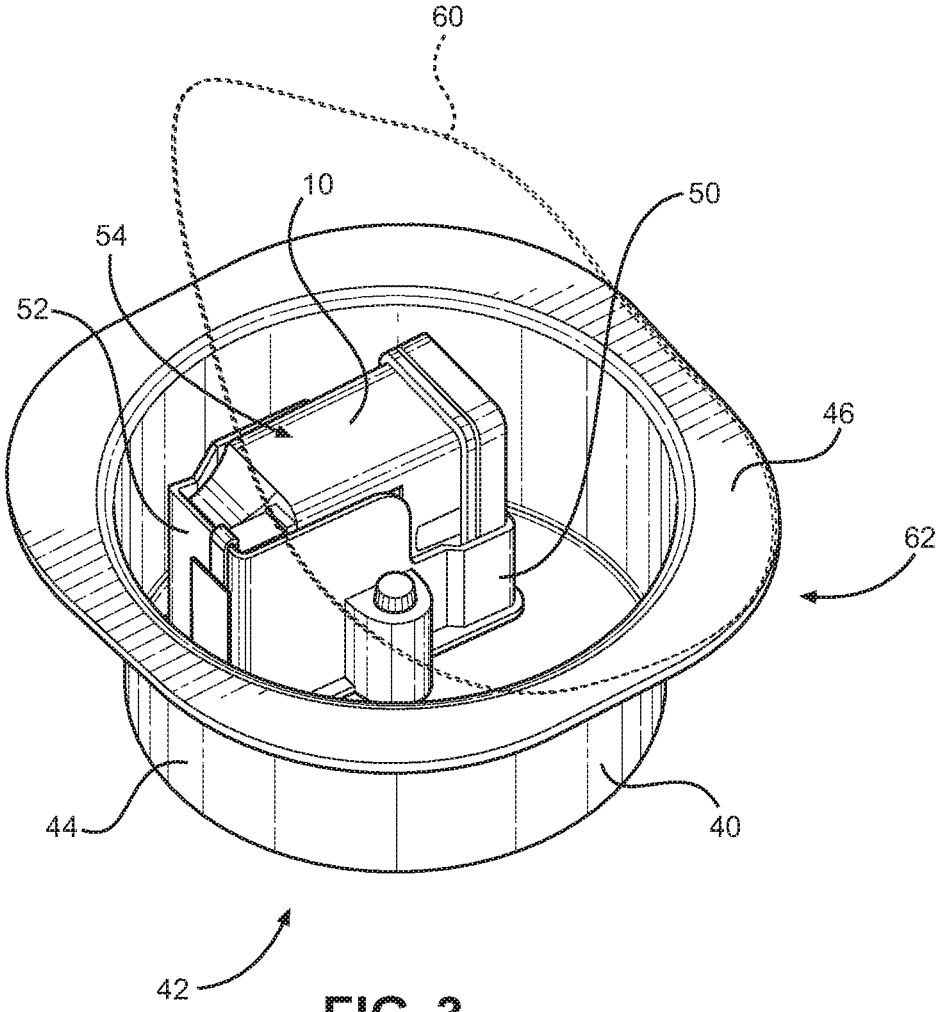
FIG. 3 is a top perspective view of a cartridge assembly in accordance with one embodiment of the present disclosure.

As noted above, the cartridge 10 may in some instances be secured within the cartridge retainer 50 such that the flexible interconnect circuit 36 attached to the cartridge wall 14 is disposed adjacent one of the retainer walls 52. Alternatively, the cartridge 10 may be secured within the cartridge retainer 50 such that the flexible interconnect circuit 36 attached to the cartridge wall is disposed adjacent the retainer opening 54. With respect to protecting the ejection chip 30 from damage during tape removal, it has been found that it is most preferred that the cartridge 10 be oriented in the cartridge retainer 50 such that the flexible interconnect circuit 36 attached to the cartridge wall is disposed one of the cartridge retainer walls 52, as shown in FIG. 3.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A packaged fluidic ejection cartridge assembly comprising:

a cartridge for fluidic ejection having a cartridge body with a plurality of cartridge walls, a cartridge lid attached to a first portion of the cartridge body, and a hollow cavity within the cartridge body defining a fluid reservoir, a fluidic ejection chip attached to a second portion of the cartridge body and in fluid flow communication with the fluid reservoir, and a volume of an ejectable fluid disposed within the fluid reservoir;

a cartridge storage container having a storage space within the container;

a cartridge retainer comprising a plurality of retainer walls and a retainer opening so as to receive and secure the cartridge, the retainer being rotatably attached to the storage container within the storage space so as to rotate about a pivot axis;

wherein the storage container may be stored with the pivot axis in either a substantially horizontal position or a substantially vertical position, and wherein each of the cartridge retainer and the cartridge have a center of mass and a combined center of mass of the cartridge retainer and the cartridge within the retainer is offset from the pivot axis so that the combined center of mass rotates to a position below the pivot axis when the packaged cartridge assembly is stored with the pivot axis in a substantially horizontal position.

2. The packaged fluidic ejection cartridge assembly of claim 1, wherein the cartridge further comprises a foam element disposed within the fluid reservoir, and wherein the cartridge is secured within the retainer such that, after the center of mass rotates to a position below the pivot axis when the packaged cartridge assembly is stored with the pivot axis in a substantially horizontal position, the ejection chip is oriented in a substantially vertical orientation.

3. The packaged fluidic ejection cartridge assembly of claim 1, wherein the cartridge further comprises a rotatable stir bar disposed within the fluid reservoir, and wherein the cartridge is secured within the retainer such that, after the center of mass rotates to a position below the pivot axis when the packaged cartridge assembly is stored with the pivot axis in a substantially horizontal position, the ejection chip is oriented in a substantially horizontal orientation.

4. The packaged fluidic ejection cartridge assembly of claim 1, wherein the cartridge storage container comprises a cartridge storage cup having a cup bottom, at least one cup sidewall, and a storage space within the cup, and wherein the cartridge retainer is rotatably attached to the cup bottom.

5. The packaged cartridge assembly of claim 4, wherein the cartridge storage cup comprises a polymeric material selected from the group consisting of polypropylene, polyethylene, and polystyrene.

6. The packaged fluidic ejection cartridge assembly of claim 1, further comprising a moisture barrier film disposed over at least the cartridge.

7. The packaged fluidic ejection cartridge assembly of claim 6, wherein the moisture barrier film comprises a multi-layer film having at least one layer which comprises a polymeric material selected from the group consisting of polypropylene, polyethylene, and polystyrene.

8. The packaged cartridge assembly of claim 4, further comprising a moisture barrier film which is thermally sealed to an upper lip area of the cartridge storage cup.

9. The packaged cartridge assembly of claim 8, wherein the ejectable fluid comprises settleable solids.

10. The packaged cartridge assembly of claim 1, wherein the cartridge body includes at least four cartridge walls.

11. The packaged cartridge assembly of claim 1, wherein the cartridge further comprises a flexible interconnect circuit which is attached to the cartridge body and electrically connected to the fluidic ejection chip.

12. A storage package for a fluidic ejection cartridge, the cartridge having a cartridge body with a plurality of cartridge walls, a cartridge lid attached to a first portion of the cartridge body, a hollow cavity within the cartridge body defining a fluid reservoir, and a fluidic ejection chip attached to a second portion of the cartridge body and in fluid flow communication with the fluid reservoir, the storage package comprising:

a cartridge storage container having a storage space within the container;

a cartridge retainer comprising a plurality of retainer walls and a retainer opening so as to receive and secure the cartridge, the retainer being rotatably attached to the storage container within the storage space so as to rotate about a pivot axis;

wherein the storage container may be stored with the pivot axis in either a substantially horizontal position or a substantially vertical position, and wherein each of the cartridge retainer and the cartridge have a center of mass and a combined center of mass of the cartridge retainer and the cartridge within the retainer is offset from the pivot axis so that the combined center of mass rotates to a position below the pivot axis when the packaged cartridge assembly is stored with the pivot axis in a substantially horizontal position.

13. The packaged fluidic ejection cartridge assembly of claim 12, wherein the cartridge further comprises a foam element disposed within the fluid reservoir, and wherein the cartridge is secured within the retainer such that, after the center of mass rotates to a position below the pivot axis when the packaged cartridge assembly is stored with the pivot axis in a substantially horizontal position, the ejection chip is oriented in a substantially vertical orientation.

14. The packaged fluidic ejection cartridge assembly of claim 12, wherein the cartridge further comprises a rotatable stir bar disposed within the fluid reservoir, and wherein the cartridge is secured within the retainer such that, after the center of mass rotates to a position below the pivot axis when the packaged cartridge assembly is stored with the pivot axis in a substantially horizontal position, the ejection chip is oriented in a substantially horizontal orientation.

15. The storage package of claim 12, wherein the cartridge storage container comprises a cartridge storage cup having a cup bottom, at least one cup sidewall, and a storage space within the cup, and wherein the cartridge retainer is rotatably attached to the cup bottom.

16. The packaged cartridge assembly of claim 15, wherein the cartridge storage cup comprises a polymeric material selected from the group consisting of polypropylene, polyethylene, and polystyrene.

17. The packaged fluidic ejection cartridge assembly of claim 12, further comprising a moisture barrier film disposed over at least the cartridge.

18. The packaged fluidic ejection cartridge assembly of claim 17, wherein the moisture barrier film comprises a multi-layer film having at least one layer which comprises a polymeric material selected from the group consisting of polypropylene, polyethylene, and polystyrene.

19. The packaged cartridge assembly of claim 15, further comprising a moisture barrier film which is thermally sealed to an upper lip area of the cartridge storage cup.

* * * * *